US007427968B2

(12) United States Patent
Chan et al.

(10) Patent No.: US 7,427,968 B2
(45) Date of Patent: Sep. 23, 2008

(54) ANTENNA DEVICE HAVING ROTATABLE STRUCTURE

(75) Inventors: Yat To Chan, Chongli (TW); Chien Te Chen, Chongli (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 288 days.

(21) Appl. No.: 11/448,310

(22) Filed: Jun. 7, 2006

(65) Prior Publication Data

US 2007/0285333 A1 Dec. 13, 2007

(51) Int. Cl.
*H01Q 3/02* (2006.01)
*H01Q 1/32* (2006.01)
*H01Q 1/12* (2006.01)

(52) U.S. Cl. ..... 343/882; 343/715; 343/888

(58) Field of Classification Search ..... 343/715, 343/872, 882, 888, 906, 889
See application file for complete search history.

(56) References Cited

U.S. PATENT DOCUMENTS

| | | | | |
|---|---|---|---|---|
| 2,850,305 | A | 9/1958 | Chadowski et al. | |
| 6,215,445 | B1 * | 4/2001 | Chang | 343/702 |
| 6,362,794 | B1 * | 3/2002 | Yu | 343/702 |
| 6,791,501 | B2 | 9/2004 | Maeda et al. | 343/715 |
| 6,999,034 | B1 * | 2/2006 | Tsai et al. | 343/715 |
| 7,046,212 | B2 * | 5/2006 | Tai et al. | 343/882 |
| 7,081,867 | B1 * | 7/2006 | Wang | 343/882 |

* cited by examiner

*Primary Examiner*—Shih-Chao Chen

(57) ABSTRACT

An antenna device includes an antenna housing having a chamber and a slot formed in one end and formed between two arms and communicating with the chamber, an antenna member having a stud engaged into the slot and rotatably coupled to the antenna housing with a pivot axle and having two or more flat surfaces formed in the stud. A spring-biased follower is slidably received in the antenna housing and includes an actuator for engaging with either of the flat surfaces of the antenna member and for anchoring and retaining the antenna member to the antenna housing at selected angular positions. The antenna device includes a greatly simplified structure with a greatly reduced expense.

6 Claims, 3 Drawing Sheets

ANTENNA DEVICE HAVING ROTATABLE STRUCTURE

BACKGROUND OF THE INVENTION

1. Field of the Invention

The present invention relates to an antenna device, and more particularly to an antenna device having a rotatable structure for allowing the antenna device to be freely rotated relative to the support object or device to selected angular directions.

2. Description of the Prior Art

Typical antenna devices comprise an antenna housing or member solidly attached or secured onto a telecommunicating facility or the other support objects or devices, and some of the antenna housings or members may include a telescopic structure for selectively extending out of the telecommunicating facility or the other support objects or devices.

For example, U.S. Pat. No. 2,850,305 to Chadowski et al. discloses one of the typical extensible automobile aerials including three sections extendible inwardly and outwardly relative to the automobile. However, the antenna may not be rotated relative to the automobile to selected angular positions, such that the typical extensible automobile aerial may not easily receive telecommunicating signals.

U.S. Pat. No. 6,791,501 to Maeda et al. discloses a typical vehicle roof mount antenna including an antenna rod to be rotatably secured to an antenna base with a joint assembly for allowing the antenna rod to be rotated relative to the antenna base to various angular directions. However, a complicated anchoring or securing structure or mechanism is required to be provided in the joint assembly for firmly securing the antenna rod to the antenna base, and thus a great expense is required for making or manufacturing the typical vehicle roof mount antenna.

The present invention has arisen to mitigate and/or obviate the afore-described disadvantages of the conventional antenna devices for telecommunicating facilities.

SUMMARY OF THE INVENTION

The primary objective of the present invention is to provide an antenna device including a rotatable structure for allowing the antenna device to be freely rotated relative to the support object or device to selected angular directions.

In accordance with one aspect of the invention, there is provided an antenna device comprising an antenna housing including a chamber formed therein, and including a slot formed in a first end and defined between two arms and communicating with the chamber thereof, an antenna member including a first end having a stud extended therefrom, for rotatably engaging into the slot of the antenna housing, and rotatably coupled to the antenna housing with a pivot axle, and including at least two flat surfaces formed in an outer peripheral portion of the stud, a follower slidably received in the chamber of the antenna housing and including an actuator extended therefrom for slidably engaging into the slot of the antenna housing and for selectively engaging with either of the flat surfaces of the antenna member, and a spring biasing device for biasing the actuator of the follower to engage with either of the flat surfaces of the antenna member and to anchor and retain the antenna member to the antenna housing at selected angular positions.

The follower includes a diameter reduced extension extended therefrom, and the biasing device includes a spring member engaged with the extension of the follower.

The antenna housing includes a second end, and a fastener attached to the second end of the antenna housing and engaged with the spring member for retaining the spring member and the follower in the chamber of the antenna housing. The fastener includes a cavity formed in a free end thereof for engaging with a driving tool.

The follower includes an outer diameter equals to an inner diameter of the chamber of the antenna housing for allowing the follower to be snugly received in the chamber of the antenna housing.

The slot of the antenna housing includes a width smaller than an inner diameter of the chamber of the antenna housing for forming an inner peripheral shoulder in the antenna housing and between the slot and the chamber of the antenna housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
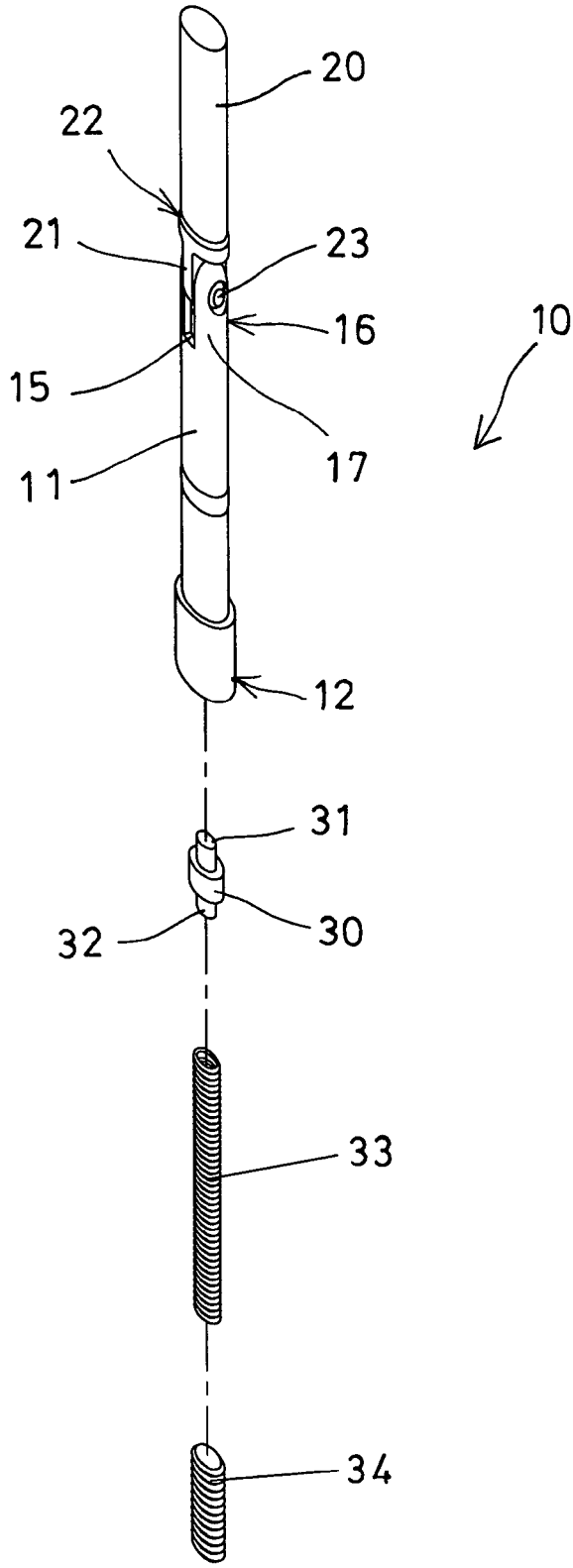
FIG. 1 is a partial exploded view illustrating an antenna device in accordance with the present invention for a telecommunicating facility or electric facility or other support objects or devices.
Figure 2:
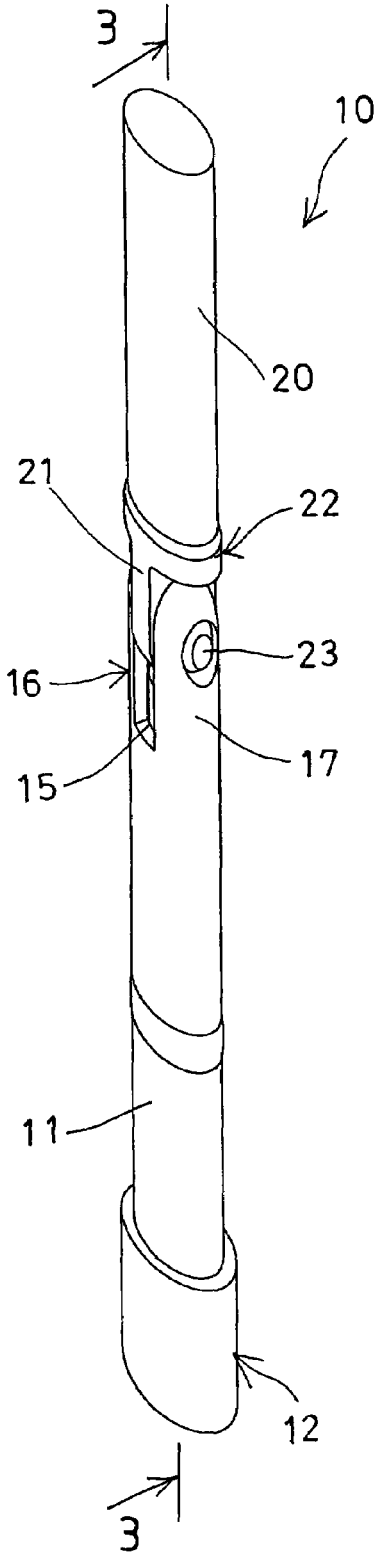
FIG. 2 is a perspective view of the antenna device.

Referring to the drawings, and initially to FIGS. 1-3 and 5, an antenna device 10 in accordance with the present invention is provided or arranged for pivotally or rotatably attached to a telecommunicating facility or electric facility or other support objects or devices (not shown), and comprises an antenna base or antenna housing 11 including one end or lower end 12 for pivotally or rotatably plugging or attaching to the telecommunicating facility or support device (not shown), and including a longitudinal chamber 13 formed therein, and including a screw hole or inner thread 14 formed in the one end or lower end 12 thereof, and including a slot 15 formed in the other end or upper end 16 thereof and formed or defined between two arms 17 and communicating with the chamber 13 thereof.

Figure 3:
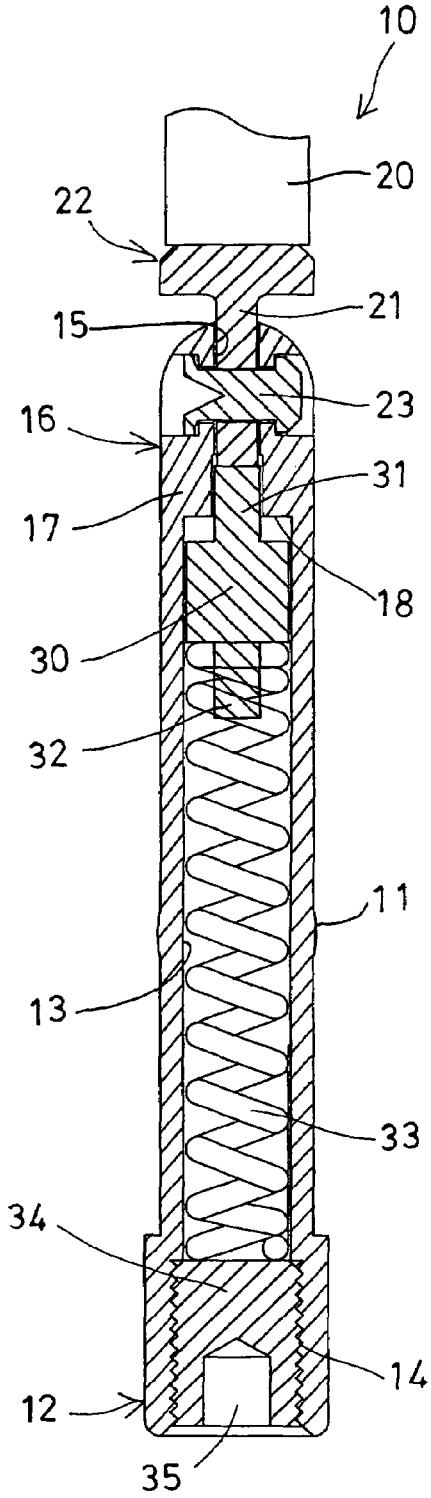
FIG. 3 is a partial cross sectional view of the antenna device, taken along lines 3-3 of FIG. 2.
Figure 5:
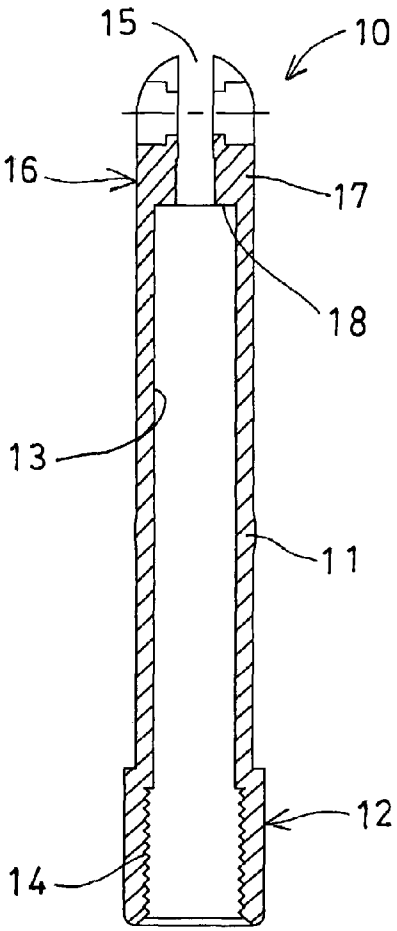
FIG. 5 is an enlarged partial cross sectional view illustrating an antenna base or antenna housing of the antenna device.
Figure 4:
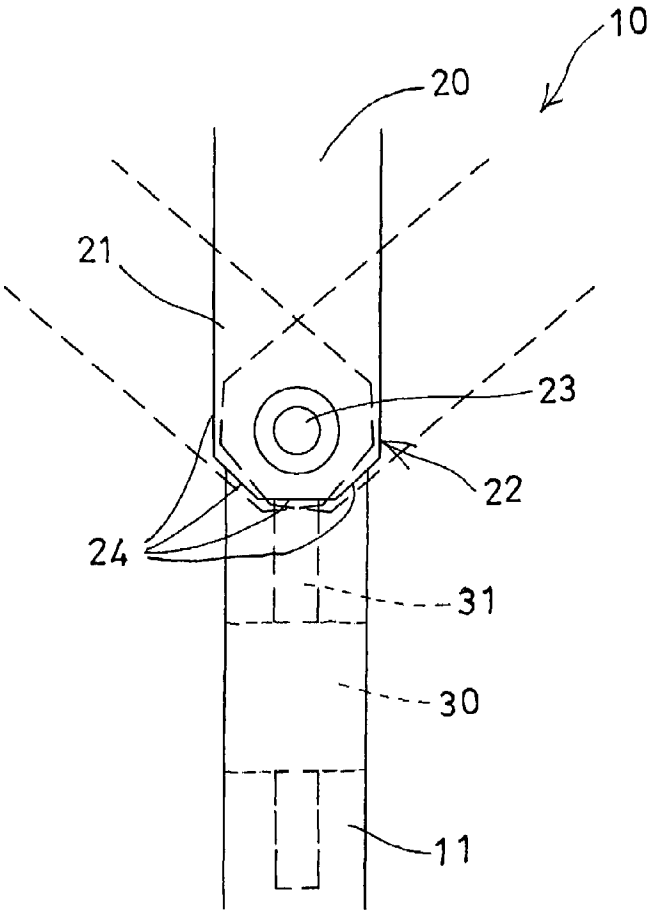
FIG. 4 is a partial side plan schematic view illustrating the operation of the antenna device.

An antenna member 20 includes a stud 21 extended from one end or lower end 22 thereof and having a reduced outer diameter than that of the antenna member 20, for rotatably receiving or engaging into the slot 15 of the antenna housing 11, and for rotatably securing or attaching to the antenna housing 11 with a pivot pin or pivot axle 23, the antenna member 20 includes two or more flat surfaces 24 (FIG. 4) formed in the outer peripheral portion of the lower end 22 or the stud 21 thereof for positioning purposes, which will be discussed hereinafter. As best shown in FIGS. 3 and 5, it is preferable that the slot 15 of the antenna housing 11 includes a width smaller than the inner diameter of the chamber 13 of the antenna housing 11 for forming an inner peripheral shoulder 18 in the antenna housing 11 or between the slot 15 and the chamber 13 of the antenna housing 11.

A follower 30 includes an outer diameter equals to or slightly smaller than the inner diameter of the chamber 13 of the antenna housing 11 for allowing the follower 30 to be snugly received in the chamber 13 of the antenna housing 11 and to be guided to slide along the chamber 13 of the antenna housing 11. The follower 30 includes a diameter reduced actuator 31 extended upwardly therefrom for slidably engaging into the slot 15 of the antenna housing 11 and for selectively engaging with either of the flat surfaces 24 of the antenna member 20 (FIGS. 3, 4), and includes a diameter reduced extension 32 extended downwardly therefrom for engaging with or for anchoring or for positioning a spring biasing means or member 33, best shown in FIG. 3.

A fastener 34 may be threaded to the inner thread 14 of the antenna housing 11 for engaging with the spring member 33 and for stably retaining the spring member 33 and the follower 30 in the chamber 13 of the antenna housing 11. The fastener 34 may include a cavity 35 formed in the outer or free end thereof (FIG. 3) for engaging with a driving tool (not shown) which may be used to rotate the fastener 34 relative to the antenna housing 11. The spring member 33 may thus be engaged between the fastener 34 and the follower 30, or may thus be engaged with the follower 30 for biasing the actuator 31 of the follower 30 to engage with either of the flat surfaces 24 of the lower end 22 of the antenna member 20, best shown in FIGS. 3 and 4, and thus for anchoring and positioning the antenna member 20 to the antenna housing 11 at selected angular positions.

In operation, it is only required to rotate the antenna member 20 relative to the antenna housing 11 to any selected angular position where the actuator 31 of the follower 30 may be biased or forced to engage with either of the flat surfaces 24 of the lower end 22 of the antenna member 20, and the antenna member 20 may then be solidly retained to the antenna housing 11 to the selected angular position by the spring biased actuator 31 of the follower 30, such that the antenna member 20 may be easily and quickly rotated relative to the antenna housing 11 to any selected angular position. The antenna device 10 includes a greatly simplified structure for firmly and stably retaining the antenna member 20 to the antenna housing 11 to any selected angular position, and for being easily made with a greatly reduced expense.

Accordingly, the antenna device in accordance with the present invention includes a rotatable structure for allowing the antenna device to be rotated and maintained relative to the support object or device at selected angular directions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An antenna device comprising:

an antenna housing including a chamber formed therein, and including a slot formed in a first end thereof and defined between two arms and communicating with said chamber thereof, an antenna member including a first end having a stud extended therefrom, for rotatably engaging into said slot of said antenna housing, and rotatably coupled to said antenna housing with a pivot axle, and including at least two flat surfaces formed in an outer peripheral portion of said stud, a follower slidably received in said chamber of said antenna housing and including an actuator extended therefrom for slidably engaging into said slot of said antenna housing and for selectively engaging with either of said at least two flat surfaces of said antenna member, and means for biasing said actuator of said follower to engage with either of said at least two flat surfaces of said antenna member and to anchor and retain said antenna member to said antenna housing at selected angular positions.

2. The antenna device as claimed in claim 1, wherein said follower includes a diameter reduced extension extended therefrom, and said biasing means includes a spring member engaged with said extension of said follower.

3. The antenna device as claimed in claim 2, wherein said antenna housing includes a second end, and a fastener attached to said second end of said antenna housing and engaged with said spring member for retaining said spring member and said follower in said chamber of said antenna housing.

4. The antenna device as claimed in claim 3, wherein said fastener includes a cavity formed in a free end thereof for engaging with a driving tool.

5. The antenna device as claimed in claim 1, wherein said follower includes an outer diameter equals to an inner diameter of said chamber of said antenna housing for allowing said follower to be snugly received in said chamber of said antenna housing.

6. The antenna device as claimed in claim 1, wherein said slot of said antenna housing includes a width smaller than an inner diameter of said chamber of said antenna housing for forming an inner peripheral shoulder in said antenna housing and between said slot and said chamber of said antenna housing.

* * * * *